United States Patent [19]

Burgess

[11] 4,266,701

[45] May 12, 1981

[54] BOOT PULL

[76] Inventor: James H. Burgess, 72-945 Tamarisk, Palm Desert, Calif. 92260

[21] Appl. No.: 71,308

[22] Filed: Aug. 30, 1979

[51] Int. Cl.[3] ..... A47J 51/02

[52] U.S. Cl. ..... 223/116

[58] Field of Search ..... 223/113, 114, 115, 116, 223/117

[56] References Cited

U.S. PATENT DOCUMENTS

| | | | |
|---|---|---|---|
| 171,398 | 12/1875 | Massie | 223/116 |
| 403,585 | 5/1889 | Hackett | 223/116 |
| 427,675 | 5/1890 | Dezell | 223/117 X |

FOREIGN PATENT DOCUMENTS

| | | | |
|---|---|---|---|
| 107303 | 6/1901 | Fed. Rep. of Germany | 223/116 |
| 1076431 | 10/1954 | France | 223/116 |
| 406463 | 3/1934 | United Kingdom | 223/113 |

*Primary Examiner*—Werner H. Schroeder
*Assistant Examiner*—Andrew M. Falik
*Attorney, Agent, or Firm*—Fulwider, Patton, Rieber, Lee & Utecht

[57] ABSTRACT

A boot pull including a frame with convergent side pieces and a pair of boot gripping members pivotably attached to the frame. The heel portion of a boot is received between the gripping members and, when the boot is lifted, the gripping members move inwardly toward each other as they pivot upwardly. In this way, the boot is grasped between the gripping members so that is is held firmly against continued upward movement. The boot pull can be held in position by placing one foot in the frame while a boot is removed from the other foot of the user.

7 Claims, 3 Drawing Figures

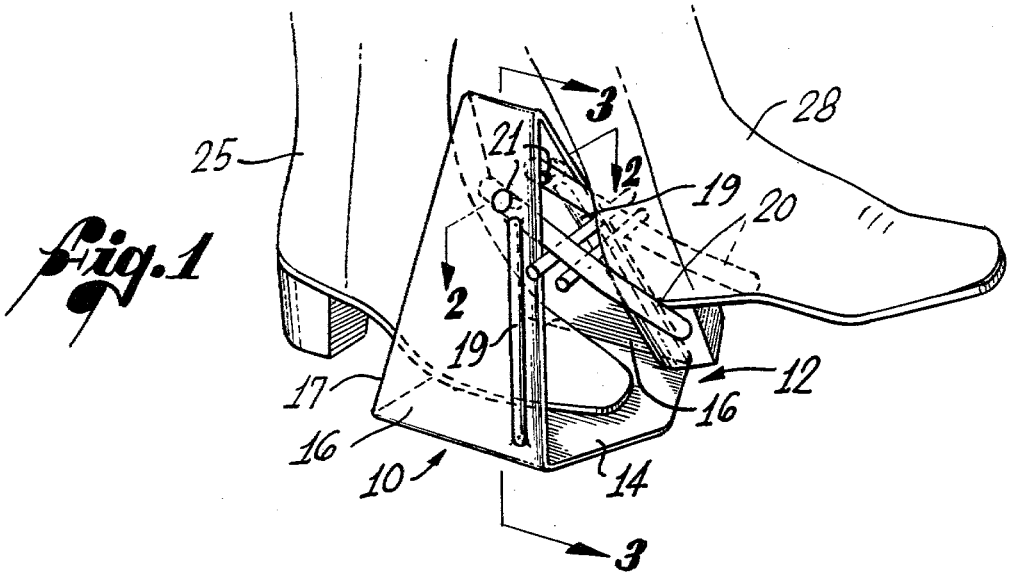
Fig. 1
Fig. 2
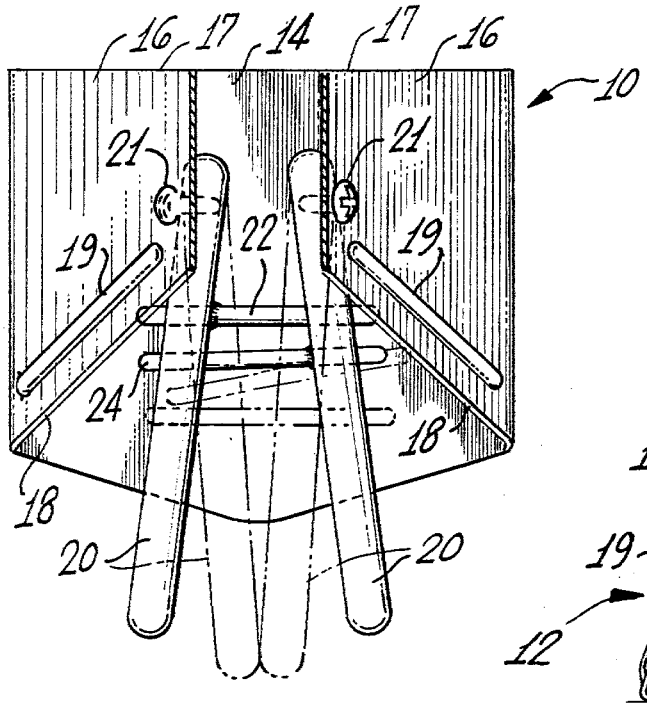
Fig. 3
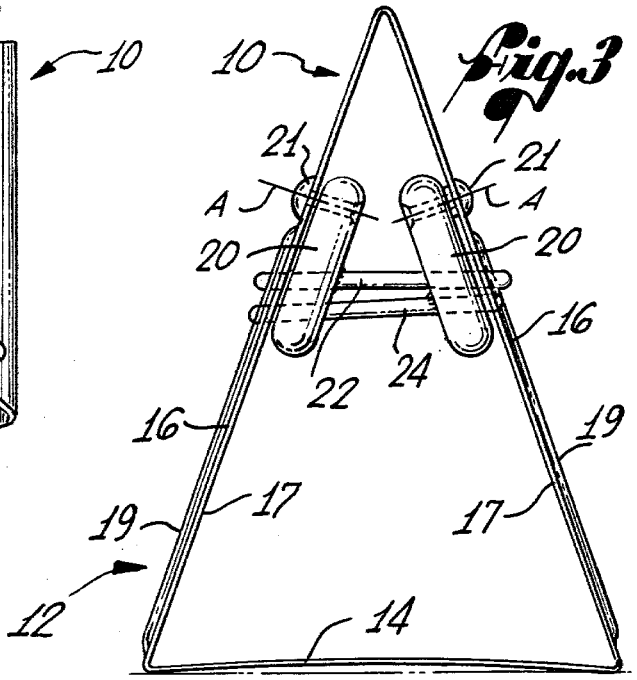

BOOT PULL

BACKGROUND OF THE INVENTION

The present invention relates to a new and improved device for use as an aid in removing boots.

It is often difficult for the wearer of boots to remove them without the help of another person, particularly when the boots are of a high and close fitting style such as western or military boots. As an aid in removing boots, a boot pull is often used. Conventionally, this device is nothing more than a board in which a V-shaped notch has been cut. The boot is kicked backwardly into the notch so that the sides of the notch pinch the boot just above the rigid portion of the heel. The wearer's foot can then be lifted upwardly within the boot while boot movement is retrained by the boot pull.

Conventional boot pulls are disadvantageous in many respects. Often the boot will be held securely only if it is kicked into the notch with considerable force. If sufficient force is used, the boot can be scuffed or otherwise damaged and the foot may be bruised. Even then, the boot can easily slip out of the notch.

Another disadvantage of a conventional boot pull is that it is not portable. It must be part of a stationary structure that will not be lifted with the boot.

A principal objective of the present invention is to provide an improved boot pull that is easily and conveniently used without damaging the boot or bruising the foot. Another objective is to provide a boot pull that lends itself to portable construction.

SUMMARY OF THE INVENTION

The boot pull constructed in accordance with the present invention includes a pair of outwardly divergent boot gripping members adapted to receive the heel portion of a boot between them. The gripping members are movably supported so that they can swing upwardly in a pivotal manner, being simultaneously forced inwardly toward each other. The heel portion of the boot can be inserted between the gripping members and pulled upwardly, whereupon the gripping members move inwardly to firmly hold the boot against continued upward movement.

Preferably, each gripping member is curved upwardly toward its outer end. A stop limits downward pivotal movement of the gripping members so that they come to rest in a starting position in which they can readily receive the boot heel between them. The invention is particularly well suited for portable construction and may include a base that can be held by one foot while a boot is removed from the other foot.

In a preferred embodiment of the invention, the boot pull includes a triangular frame formed by a base plate and two inclined side pieces. The gripping members are pivotally attached to the side pieces in such a manner that they have pivot axes perpendicular to the side pieces. These pivot axes form an oblique angle with each other.

BRIEF DESCRIPTION OF THE DRAWINGS

FIG. 1 is a pictorial illustration of a boot pull constructed in accordance with the present invention, the feet of the user also being shown;

FIG. 2 is a cross-sectional view of the boot pull, taken along the lines 2—2 of FIG. 1; and FIG. 3 is a view of the back of the boot pull, taken as indicated by the lines 3—3 of FIG. 1.

DESCRIPTION OF THE PREFERRED EMBODIMENT

A boot pull 10 constructed in accordance with the present invention includes a triangular sheet metal frame 12 formed by a horizontal base plate 14 that rests on the floor and a pair of convergent side pieces 16 each of which is bent upwardly from one side edge of the base plate. The side pieces are joined together in a V-shaped formation at their top ends.

The trailing edges 17 of the side pieces 16 are vertical but the leading edges 18 are inclined so that the side pieces are narrower at the top than at the bottom. Each side piece is creased to form a rib 19 extending parallel to its leading edge 18 for increased rigidity.

A pair of boot gripping members 20 project forwardly from the side pieces 16. Each gripping member 20 is essentially a rigid, solid, metal rod that curves upwardly toward its outer end. The outer ends have plastic coatings to protect the boots of a user.

Each gripping member 20 is pivotally attached to the corresponding side piece 16 by a screw 21 that is arranged with its head on the outside of the side piece so that it extends through the side piece into the corresponding gripping member. A shaft of each screw 21 forms a pivot axis (designated A in FIG. 3) for a gripping member 20, the axis being perpendicular to the side piece 16. The two pivot axes A form an oblique angle with each other as may be seen in FIG. 3.

Each gripping member 20 is welded to a cross bar 22, 24 that extends substantially perpendicularly to that gripping member and beneath the other gripping member. Accordingly, these cross bars 22 and 24 force the gripping members 20 to move in unison. One cross bar 22 is closer to the leading edges 18 of the side pieces 16 than the other and that cross bar is wide enough that it rests against the side pieces when the gripping members are permitted to pivot downwardly under the force of gravity. Thus, the outer ends of the rearmost cross bar 22 form stops that limit the downward travel of the gripping members 20 to a boot receiving position.

The use of the invention will be explained with respect to a person who wishes to remove his left boot (as shown in FIG. 1). This person places his right foot 26 inside the triangular frame 12 so that he is standing on the base plate 14 to hold the boot pull 10 in position. He then places his left foot 28 in front of the boot pull 10 and moves it backwardly to gently engage the gripping members 20 with the left boot just above the rigid portion of the heel. The curvature of the gripping members 20 causes them to receive the boot 28 at a convenient angle and guides the heel of the boot into the proper position.

While pressing backward gently, the user lifts his left foot 28. The gripping members 20 begin to travel upwardly with the boot 28. As they do so, they are forced inwardly (toward the position shown in phantom lines in FIG. 2) due to the incline side pieces 16 to the pivot axes A.

It should be noted that the boot pull 10 of the invention can be used with either foot. Thus, after the user has removed his left boot 28 he reverses the procedure, using his left foot to secure the boot pull 10 while he removes the right boot 26.

It will be apparent from the description above that the invention provides a highly convenient, easy to use, portable boot pull that is of simple construction and inexpensive to manufacture, yet avoids damage to the boot and injury to the foot.

While a particular form of the invention has been illustrated and described, it will also be apparent that various modifications can be made without departing from the spirit and scope of the invention.

I claim:

1. A boot pull comprising:

a pair of outwardly divergent boot gripping members adapted to receive the heel portion of a boot between them;

a pair of side pieces that converge toward a point above said gripping members; and means for pivotally attaching said gripping members to said side pieces and for causing movement of said gripping members toward each other as they pivot upwardly, whereby a boot can be removed from the wearer's foot by inserting it between said gripping members and pulling upwardly causing said gripping members to move inwardly to firmly hold said boot against continued upward movement.

2. The boot pull of claim 1 wherein said gripping members are curved upwardly toward their outer ends.

3. The boot pull of claim 2 further comprising means for limiting downward movement of said gripping members.

4. A boot pull comprising:

a triangular frame including a base plate and two convergent side pieces that extend upwardly from said base plate;

a pair of outwardly divergent boot gripping members adapted to receive the heel portion of a boot between them; and means for pivotally attaching said gripping members to said side pieces on pivot axes perpendicular to said side pieces and thereby causing said gripping members to move inwardly toward each other as they pivot upwardly;

whereby a user can place one foot on said base plate to hold said boot pull in place and can then place the heel portion of a boot on the other foot between said gripping members and pull upwardly to remove said boot.

5. The boot pull of claim 4 wherein said gripping members are curved upwardly at their outer ends.

6. The boot pull of claim 5 further comprising means for limiting downward movement of said gripping members.

7. A boot pull comprising:

a triangular sheet metal frame including a base plate and two convergent side pieces that extend upwardly from said base plate in a V-shaped formation;

a pair of outwardly divergent boot gripping members curved upwardly at their outer ends and adapted to receive the heel portion of a boot between them;

means for pivotally attaching said gripping members to said side pieces on pivot axes perpendicular to said side pieces and thereby causing said gripping members to move inwardly toward each other as they pivot upwardly; and stop means for limiting downward movement of said gripping members, said stop means comprising at least one stop member carried by one of said gripping members and engageable with said side pieces;

whereby a user can place a foot on the base plate to hold said boot pull in place and can then place the heel portion of a boot between said gripping members and pull upwardly to remove said boot.

* * * * *

UNITED STATES PATENT AND TRADEMARK OFFICE

CERTIFICATE OF CORRECTION

PATENT NO. : 4,266,701

DATED : May 12, 1981

INVENTOR(S) : JAMES H. BURGESS

It is certified that error appears in the above-identified patent and that said Letters Patent are hereby corrected as shown below:

In the abstract, line 8, "is" (first occurrence) should be --it--;

Signed and Sealed this

*Fourth* Day of *August 1981*

[SEAL]

*Attest:*

GERALD J. MOSSINGHOFF

*Attesting Officer*

*Commissioner of Patents and Trademarks*